US008720019B2

(12) United States Patent
Buckingham et al.

(10) Patent No.: US 8,720,019 B2
(45) Date of Patent: May 13, 2014

(54) BUCKLE ASSEMBLIES FOR PERSONAL RESTRAINT SYSTEMS AND ASSOCIATED METHODS OF USE AND MANUFACTURE

(75) Inventors: Fred Buckingham, Elkhart, IN (US); Mark E. Main, Bremen, IN (US)

(73) Assignee: AmSafe Commercial Products, Inc., Elkhart, IN (US)

( * ) Notice: Subject to any disclaimer, the term of this patent is extended or adjusted under 35 U.S.C. 154(b) by 296 days.

(21) Appl. No.: 12/943,811

(22) Filed: Nov. 10, 2010

(65) Prior Publication Data

US 2011/0107560 A1 May 12, 2011

Related U.S. Application Data

(60) Provisional application No. 61/259,848, filed on Nov. 10, 2009.

(51) Int. Cl.
*A44B 11/00* (2006.01)

(52) U.S. Cl.
USPC ..... 24/633; 24/632; 24/641

(58) Field of Classification Search
USPC ..... 24/629–633, 636, 637, 640, 641, 643, 24/644, 647, 579.11
See application file for complete search history.

(56) References Cited

U.S. PATENT DOCUMENTS

| | | | | |
|---|---|---|---|---|
| 3,799,610 | A | | 3/1974 | Hollins |
| 4,604,773 | A | | 8/1986 | Weber et al. |
| 4,679,852 | A | | 7/1987 | Anthony et al. |
| 4,699,401 | A | | 10/1987 | Saenz |
| 4,738,485 | A | | 4/1988 | Rumpf |
| 4,785,906 | A | | 11/1988 | Kang |
| 4,884,652 | A | | 12/1989 | Vollmer |
| 4,989,299 | A | | 2/1991 | Morita |
| 5,038,446 | A | * | 8/1991 | Anthony et al. ..... 24/579.11 |
| 5,061,012 | A | | 10/1991 | Parker et al. |
| 5,142,748 | A | * | 9/1992 | Anthony et al. ..... 24/579.11 |
| 5,182,837 | A | * | 2/1993 | Anthony et al. ..... 24/642 |
| 5,233,732 | A | | 8/1993 | Yamanishi |
| 5,383,708 | A | | 1/1995 | Nagasaka et al. |
| 5,429,419 | A | | 7/1995 | Kassai et al. |
| 5,458,369 | A | | 10/1995 | Matsuki et al. |
| 5,511,856 | A | * | 4/1996 | Merrick et al. ..... 297/476 |
| 5,526,556 | A | * | 6/1996 | Czank ..... 24/637 |
| 5,606,783 | A | * | 3/1997 | Gillis et al. ..... 24/632 |
| 5,699,594 | A | * | 12/1997 | Czank et al. ..... 24/632 |

(Continued)

FOREIGN PATENT DOCUMENTS

| | | |
|---|---|---|
| EP | 1547484 | 6/2005 |
| JP | 2005178513 | 7/2005 |
| JP | 4604482 | 1/2011 |
| WO | WO-2012/037398 | 3/2012 |

*Primary Examiner* — Robert J Sandy
*Assistant Examiner* — Michael Lee
(74) *Attorney, Agent, or Firm* — Perkins Coie LLP

(57) ABSTRACT

Personal restraint systems with buckle assemblies for use in vehicles are disclosed herein. In one embodiment, a personal restraint system includes a connector configured to be coupled to a web. The restraint system also includes a buckle assembly configured to releasably retain the connector. In this embodiment, the buckle assembly includes a frame having a locking feature configured to engage a tongue of the connector. The buckle assembly also includes a locking member movably positioned adjacent to the frame that retains the tongue in a locked position. The buckle assembly further includes an actuator that can be actuated by a user to move the tongue out of the locked position.

17 Claims, 12 Drawing Sheets

(56) References Cited

U.S. PATENT DOCUMENTS

| | | | | |
|---|---|---|---|---|
| D397,063 | S | 8/1998 | Woellert et al. | |
| 5,813,097 | A * | 9/1998 | Woellert et al. | 24/631 |
| 5,873,599 | A | 2/1999 | Bauer et al. | |
| 5,890,762 | A | 4/1999 | Yoshida | |
| 5,970,587 | A | 10/1999 | Knox | |
| 6,024,408 | A | 2/2000 | Bello et al. | |
| 6,139,111 | A | 10/2000 | Pywell et al. | |
| 6,182,783 | B1 | 2/2001 | Bayley | |
| 6,357,790 | B1 | 3/2002 | Swann et al. | |
| 6,540,293 | B1 | 4/2003 | Quackenbush | |
| 6,547,218 | B2 | 4/2003 | Landy | |
| 6,582,015 | B2 | 6/2003 | Jessup et al. | |
| 6,647,597 | B2 | 11/2003 | Reiter | |
| 6,698,070 | B2 | 3/2004 | Chen | |
| 6,701,587 | B1 * | 3/2004 | Sato et al. | 24/633 |
| 6,773,075 | B2 | 8/2004 | Rouhana et al. | |
| 6,817,629 | B2 | 11/2004 | Herberg et al. | |
| 6,837,547 | B2 | 1/2005 | Delventhal et al. | |
| 7,011,341 | B2 | 3/2006 | Herberg et al. | |
| 7,077,475 | B2 | 7/2006 | Boyle | |
| 7,159,948 | B1 | 1/2007 | Wolf | |
| 7,178,208 | B2 | 2/2007 | Bentsen et al. | |
| 7,201,399 | B2 | 4/2007 | Frank et al. | |
| 7,246,854 | B2 | 7/2007 | Dingman et al. | |
| 7,278,684 | B2 | 10/2007 | Boyle | |
| 7,350,767 | B2 | 4/2008 | Huang | |
| 7,466,221 | B1 | 12/2008 | Lehr | |
| 7,625,048 | B2 | 12/2009 | Rouhana et al. | |
| 7,673,906 | B2 | 3/2010 | Bell | |
| 7,770,969 | B2 | 8/2010 | Boyle et al. | |
| 7,775,557 | B2 | 8/2010 | Bostrom et al. | |
| 7,976,092 | B2 | 7/2011 | Meredith et al. | |
| 8,016,318 | B2 | 9/2011 | Nezaki | |
| 8,066,303 | B2 | 11/2011 | Nezaki | |
| 8,113,584 | B2 | 2/2012 | Boyle et al. | |
| 2006/0038436 | A1 | 2/2006 | Siewertsen et al. | |
| 2006/0049677 | A1 | 3/2006 | Lawrence et al. | |
| 2007/0001495 | A1 | 1/2007 | Boyle et al. | |
| 2007/0210639 | A1 | 9/2007 | Berger et al. | |
| 2007/0261217 | A1 | 11/2007 | Buscart | |
| 2009/0183348 | A1 | 7/2009 | Walton et al. | |
| 2009/0278390 | A1 | 11/2009 | Carter | |
| 2010/0033001 | A1 | 2/2010 | Boyer | |
| 2010/0201170 | A1 | 8/2010 | Brandl et al. | |
| 2010/0213753 | A1 | 8/2010 | Humbert | |
| 2010/0253121 | A1 | 10/2010 | Buckingham et al. | |
| 2011/0291451 | A1 | 12/2011 | Westman | |
| 2012/0080917 | A1 | 4/2012 | Miller et al. | |

* cited by examiner

BUCKLE ASSEMBLIES FOR PERSONAL RESTRAINT SYSTEMS AND ASSOCIATED METHODS OF USE AND MANUFACTURE

CROSS-REFERENCE TO RELATED APPLICATIONS

The present application claims priority under 35 U.S.C. §119(e) of U.S. Provisional Application Ser. No. 61/259,848, filed Nov. 10, 2009, the disclosure of which is incorporated herein by reference in its entirety.

TECHNICAL FIELD

The following disclosure relates generally to personal restraint systems for use in vehicles and, more particularly, to buckle assemblies and associated connectors for use with child seats and other restraint systems.

BACKGROUND

There are many types of personal restraint systems for use in automobiles, aircraft, all-terrain-vehicles, and other vehicles. Such systems include, for example, seat belts for use by adults and children of sufficient size, and child seats with associated restraints for use by toddlers and small children.

One method of securing the seat belts or webs around an occupant includes releasably attaching an end portion of each of the webs to a buckle assembly. The buckle assembly retains the webs around the occupant during use, and also enables the occupant to release or separate the webs after use. Conventional buckle assemblies can be positioned to the side of an occupant or in front of an occupant. For example, a "three point" harness system, as typically found in conventional automobiles, can include a shoulder web and a lap web that are releasably secured to a buckle assembly positioned proximate to the occupant's hip. A "five point" harness system can include a crotch web, first and second shoulder webs, and first and second lap webs that are releasably secured to a buckle assembly positioned proximate to the occupant's mid-section.

DETAILED DESCRIPTION

The following disclosure describes buckle assemblies and associated web connectors for use with child seats and other personal restraint systems in vehicles. As described in greater detail below, a personal restraint system configured in accordance with one aspect of the disclosure can include two web connectors with corresponding tongues that are releasably engaged with a corresponding buckle assembly. Certain details are set forth in the following description and in FIGS. 1-9H to provide a thorough understanding of various embodiments of the disclosure. However, other details describing well-known structures and systems often associated with buckle assemblies, web connectors, and/or other aspects of personal restraint systems are not set forth below to avoid unnecessarily obscuring the description of various embodiments of the disclosure.

Many of the details, dimensions, angles, and other features shown in the Figures are merely illustrative of particular embodiments of the disclosure. Accordingly, other embodiments can have other details, dimensions, angles, and features without departing from the spirit or scope of the present disclosure. In addition, those of ordinary skill in the art will appreciate that further embodiments of the disclosure can be practiced without several of the details described below.

In the Figures, identical reference numbers identify identical or at least generally similar elements. To facilitate the discussion of any particular element, the most significant digit or digits of any reference number refers to the Figure in which that element is first introduced. For example, element 110 is first introduced and discussed with reference to FIG. 1.

Figure 1:
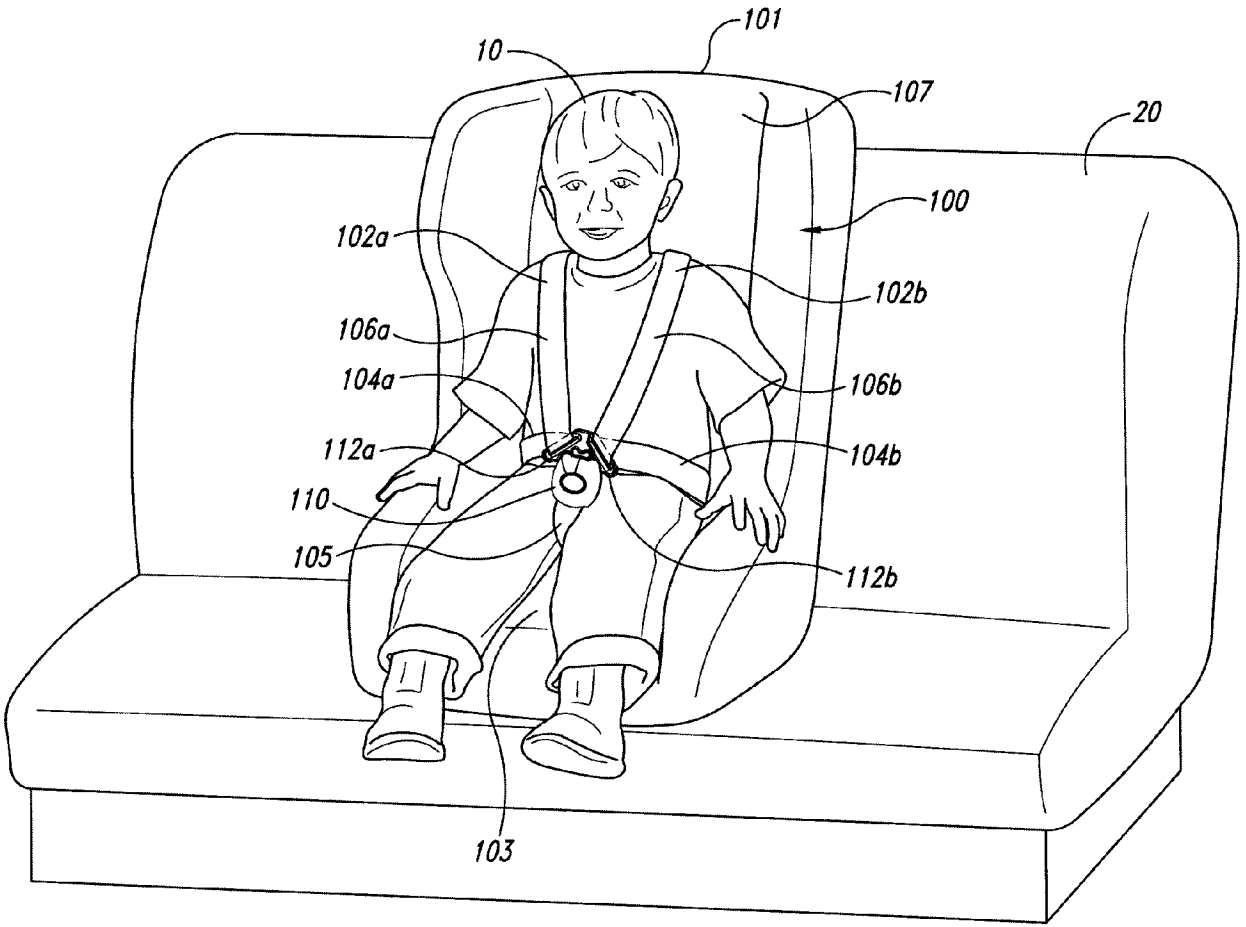
FIG. 1 is an isometric view of a child secured in a child seat with a restraint system having a buckle assembly configured in accordance with an embodiment of the disclosure.

FIG. 1 is an isometric view illustrating a restraint system 100 having a buckle assembly 110 configured in accordance with an embodiment of the disclosure. In the illustrated embodiment, the restraint system 100 holds a vehicle occupant 10 (e.g., a child) in a child seat 101. In other embodiments, however, the restraint system 100 and associated buckle assembly 110 can restrain other types of occupants in vehicles without a child seat 101. In the illustrated embodiment, the child seat 101 includes a base portion 103 and a back portion 107. The child seat 101 can be secured to a vehicle seat 20 using various systems known in the art. Such systems can include, for example, belts or webs (not shown) having proximal ends attached to the child seat 101 and distal ends attached to anchors (also not shown) in the bight of the vehicle seat 20 with suitable couplings. In other embodiments, the child seat 101 can be secured to the vehicle seat 20, and/or other vehicle structures, using other suitable methods known in the art. Moreover, in further embodiments the child seat 101 or variations thereof can be reversed so that the child seat 101 is facing rearward toward the vehicle seat 20. Accordingly, as the foregoing illustrates, embodiments of the present disclosure and applications of the buckle assemblies and web connectors disclosed herein are not limited to the particular child seat configuration illustrated in FIG. 1.

In the illustrated embodiment, the restraint system 100 includes a first shoulder web 102*a* and a second shoulder web 102*b* extending from the back portion 107 of the child seat 101. The shoulder webs 102 can include various types of woven fabric materials and/or other suitable belt or strap materials known in the art that provide sufficient strength, flexibility, durability and/or other characteristics. In this embodiment, each of the shoulder webs 102 slidably passes through an aperture in a corresponding web connector 112 (identified individually as a first web connector 112*a* and a second web connector 112*b*). Passing the shoulder webs 102 through the web connectors 112 divides each of the shoulder webs 102 into a corresponding shoulder web portion 106 (identified individually as a first shoulder web portion 106*a* and a second shoulder web portion 106*b*), and a corresponding lap web portion 104 (identified individually as a first lap web portion 104*a* and a second lap web portion 104*b*). The lap web portions 104 extend away from each other toward opposite sides of the child seat 101. The end portions of the shoulder webs 102 can be secured or otherwise affixed to the child seat 101 and/or other adjacent structures using various methods known in the art.

As described in greater detail below, the web connectors 112 can be releasably coupled to the buckle assembly 110. In the illustrated embodiment, the buckle assembly 110 is attached to a distal end of a crotch web 105 that extends from the base portion 103 of the child seat 101. The proximal end of the crotch web 105 can be secured to the child seat 101 and/or other adjacent structures using various methods known in the art. Although FIG. 1 illustrates one possible use of the buckle assembly 110 (e.g., use with a "five point" harness), those of ordinary skill in the art will appreciate that the buckle assembly 110 and the other components of the restraint system 100 can be used in a number of other restraint system applications without departing from the spirit or scope of the present disclosure.

Figure 2A:
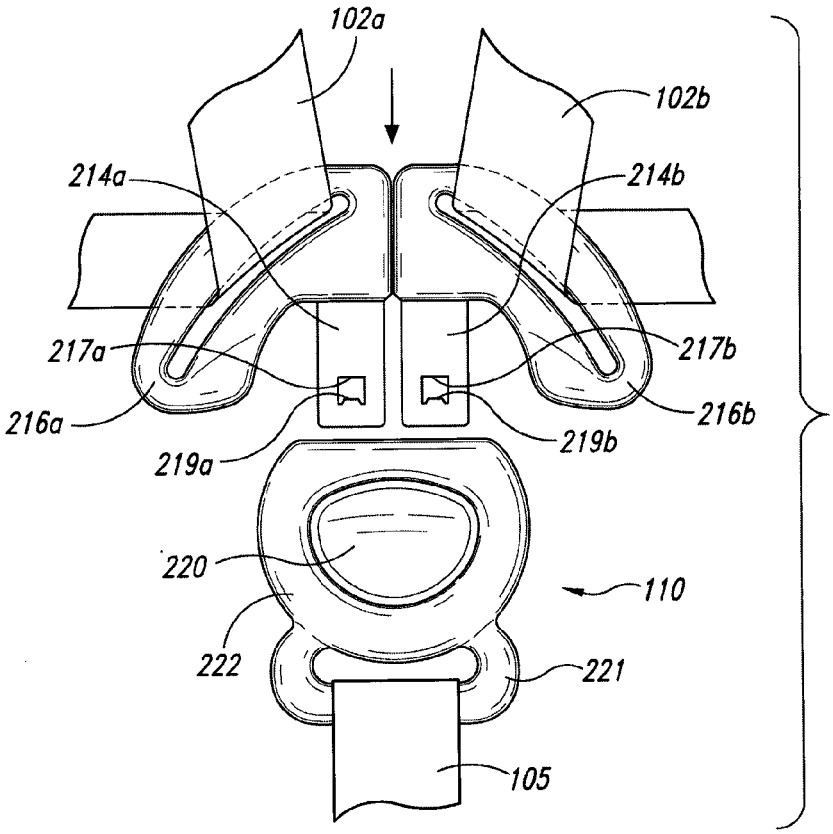
FIGS. 2A and 2B are a series of top views illustrating various operational aspects of the buckle assembly and web connectors shown in FIG. 1.
Figure 2B:
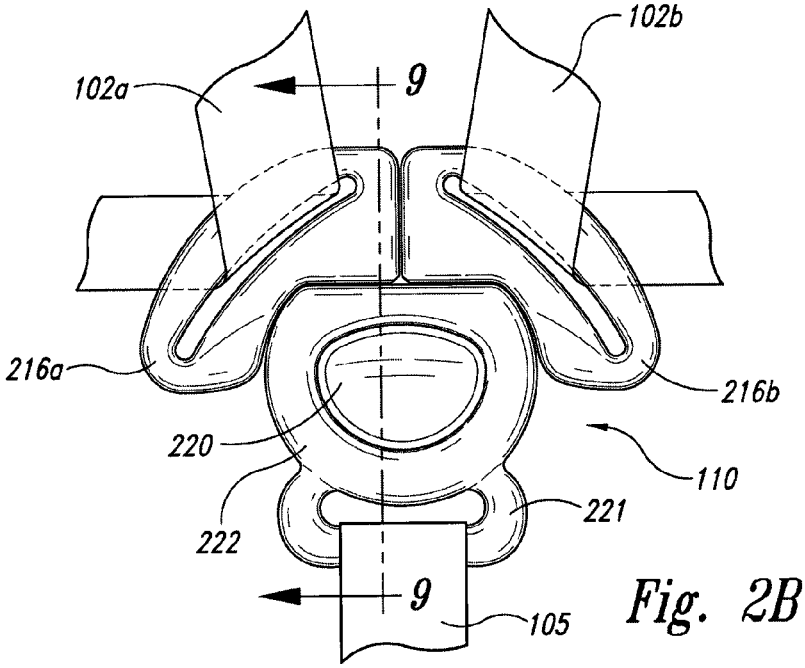

FIGS. 2A and 2B are a series of top views illustrating various operational aspects of the buckle assembly 110 and web connectors 112 shown in FIG. 1. Referring first to FIG. 2A, each of the web connectors 112 includes a tongue 214 (identified individually as a first tongue 214*a* and a second tongue 214*b*) and a web receiving portion 216 (identified individually as a first web receiving portion 216*a* and a second web receiving portion 216*b*). Each tongue 214 includes a locking feature or pawl aperture 217 (identified individually as a first pawl aperture 217*a* and a second pawl aperture 217*b*) having an engagement portion or edge 219 (identified individually as a first engagement edge 219*a* and a second engagement edge 219*b*). Each of the web receiving portions 216 slidably receives one of the corresponding shoulder webs 102.

In another aspect of this embodiment, the buckle assembly 110 includes a release actuator or button 220 at least partially positioned within a housing 222. The buckle assembly 110 also includes a web receiving portion 221 that slidably receives the crotch web 105. To releasably engage the web connectors 112 with the buckle assembly 110, a user can push the tongues 214 into the buckle assembly 110 until they fully engage the buckle assembly 110 as illustrated in FIG. 2B (e.g., until the engagement edge 219 of each tongue 214 engages corresponding locking features of the buckle assembly 110). Further details and associated operational aspects of the buckle assembly 110 are described below with reference to FIGS. 3-9H.

Figure 3:
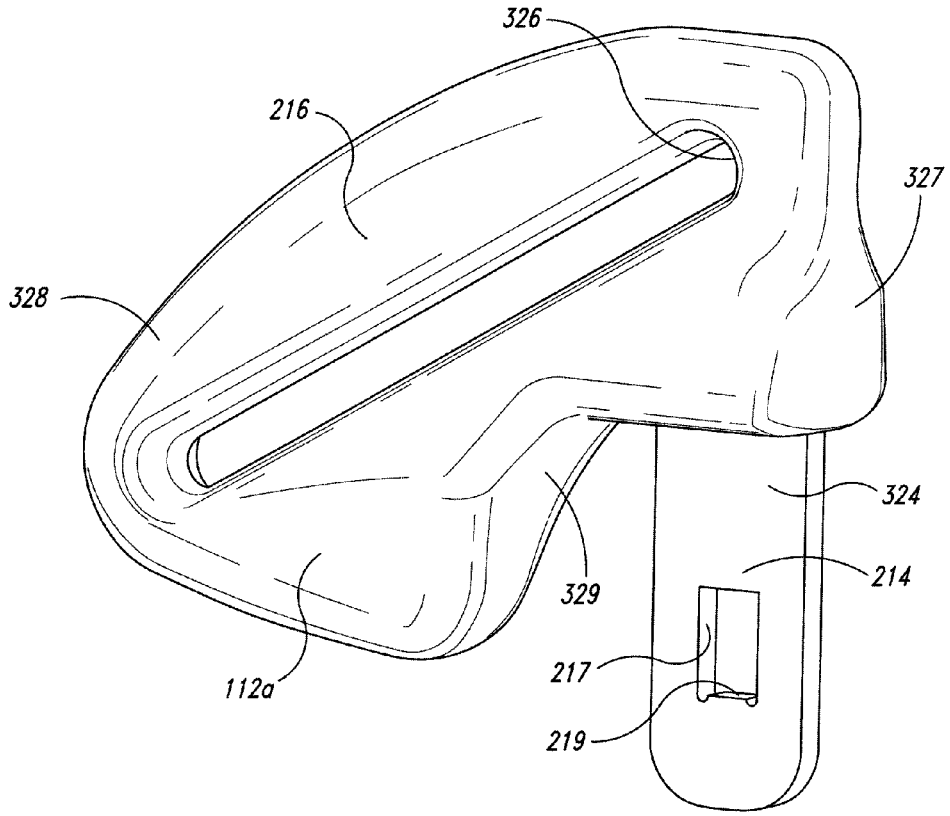
FIG. 3 is an isometric view of one of the web connectors of FIGS. 1-2B.

FIG. 3 is an isometric view of the first web connector 112*a* of FIGS. 1-2B. As will be appreciated by one of ordinary skill in the art, the features described with reference to the first web connector 112*a* of FIG. 3 are also included in the second web connector 112*b*. In the illustrated embodiment, the first web connector 112*a* includes a connector body 324 comprising the tongue 214 and the web receiving portion 216. In certain embodiments, the connector body 324 can be formed from metal, such as plate steel that is stamped or otherwise formed using suitable methods. In other embodiments, however, the connector body 324 can be made from other suitable metals or other materials. As noted above, the tongue 214 includes the engagement edge 219 of the pawl aperture 217. The connector body 324 also includes a web aperture 326 in the web receiving portion 216 to slidably receive the corresponding shoulder web 102 (FIGS. 1-2B).

In another aspect of this embodiment, the first web connector 112*a* includes a durable cover 328 that fits over the web receiving portion 216 of the connector body 324 to facilitate grasping and manipulation of the first web connector 112*a* by a user. The cover 328 has an inner edge portion 327 that provides a complimentary fit with a corresponding inner edge portion of the second web connector 112*b* when the connectors 112 are inserted into the buckle assembly 110 (FIG. 2B). The cover 328 also has an outer edge portion 329 that generally corresponds to the shape of the housing 222 of the buckle assembly 110 when the first web connector 112*a* is fully inserted into the buckle assembly 110. In certain embodiments, the cover 328 can be formed from textured plastic and/or other suitable materials that are bonded, press fit, and/or otherwise attached to the connector body 324. In one embodiment, for example, the cover 328 can be formed from a tactile material, such as the material disclosed in U.S. Provisional Patent Application No. 61/258,110, entitled "COATINGS FOR BUCKLE ASSEMBLY COMPONENTS AND ASSOCIATED METHODS OF USE AND MANUFACTURE" and filed Nov. 4, 2009, which is incorporated herein in its entirety by reference.

Figure 4:
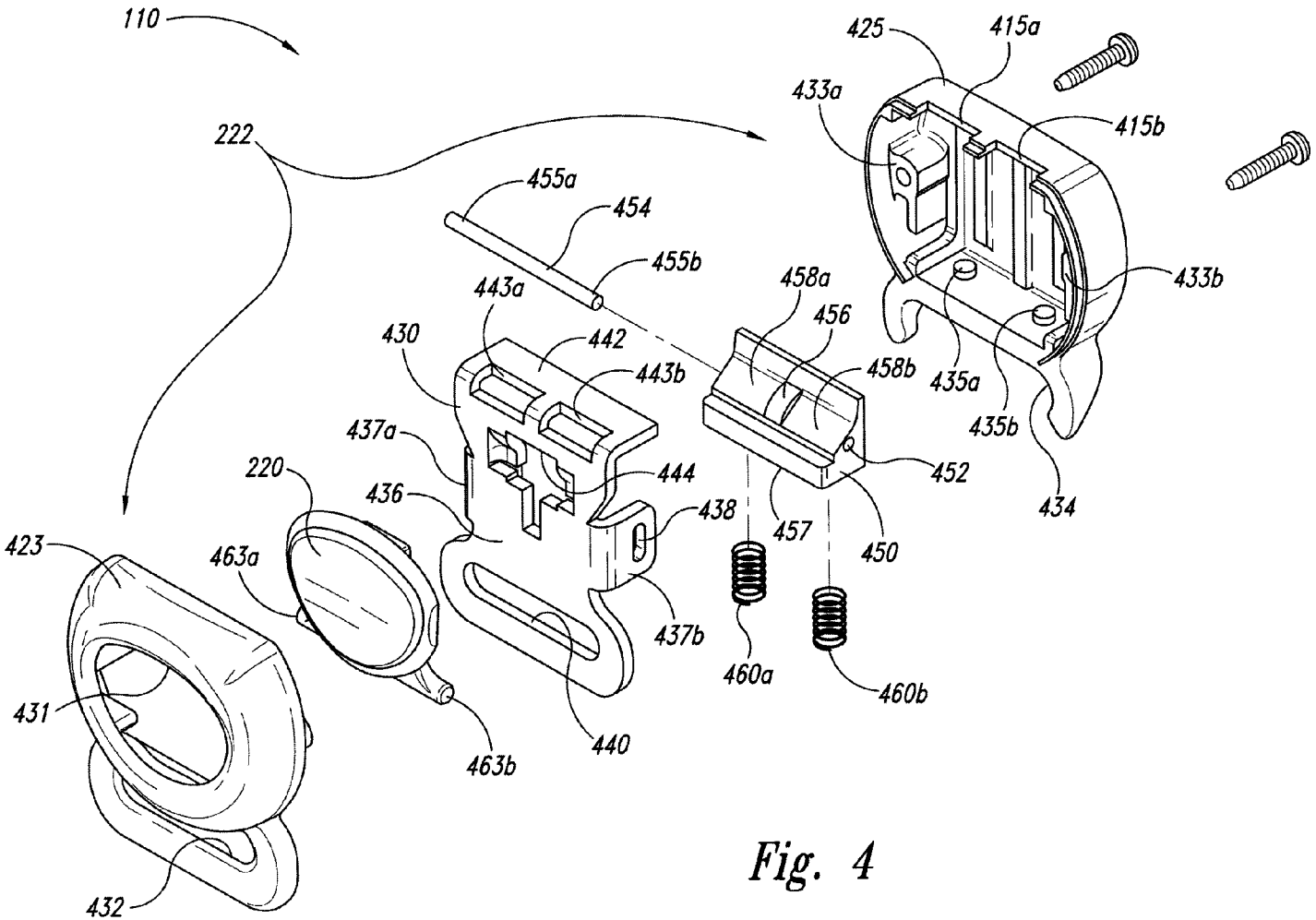
FIG. 4 is an exploded isometric view of the buckle assembly of FIGS. 1-2B.

FIG. 4 is an exploded isometric view illustrating various components of the buckle assembly 110. In one aspect of this embodiment, the housing 222 of the buckle assembly 110 includes a first or top cover 423 opposite a second or bottom cover 425. The top cover 423 can include a button aperture 431 and a web opening 432. The bottom cover 425 can include cover locating features 433 (identified individually as a first cover locating feature 433*a* and a second cover locating feature 433*b*) projecting upwardly therefrom. The bottom cover 425 also includes a web recess 434 opposite two tongue recesses 415 (identified individually as a first tongue recess 415*a* and a second tongue recess 415*b*). The bottom cover 425 further includes biasing member locating features 435 (identified individually as a first biasing member locating feature 435*a* and a second biasing member locating feature 435*b*). Further details regarding the top cover 423 and the bottom cover 425 are described below with reference to FIGS. 5A and 5B, respectively.

In another aspect of the embodiment illustrated in FIG. 4, the buckle assembly 110 includes a frame 430 configured to be positioned in the housing 222. The frame 430 includes opposing sidewalls 437 (identified individually as a first sidewall 437*a* and a second sidewall 437*b*) extending away from a base 436. Each of the sidewalls 437 includes a guide channel 438. The frame 430 also includes an attachment opening 440 (e.g., a web attachment opening) opposite a tongue receiving portion 442. The tongue receiving portion 442 includes two tongue apertures or openings 443 (identified individually as a first tongue opening 443*a* and a second tongue opening 443*b*) that are configured to be aligned with the tongue recesses 415 in the bottom cover 425 to receive the tongues 214 of the corresponding web connectors 112 (FIGS. 2A and 2B). The frame 430 further includes a button opening 444 that receives at least a portion of the button 220 as the button 220 moves in the buckle assembly 110. Further details regarding the frame 430 are described below with reference to FIG. 6.

In yet another aspect of the embodiment illustrated in FIG. 4, the buckle assembly 110 also includes a locking member 450 that is slidably positioned between the frame 430 and the bottom cover 425. The locking member 450 includes a pin opening 452 extending laterally therethrough that is configured to receive a guide member or pin 454 (e.g., an elongate metal pin or rod). The pin 454 has end portions 455 (identified individually as a first end portion 455*a* opposite a second end portion 455*b*) that are slidably received in the guide channels 438 of the corresponding sidewalls 437 of the frame 430. The locking member 450 also includes a button contact surface 456 positioned between tongue contact surfaces 458 (identified individually as a first tongue contact surface 458*a* and a second tongue contact surface 458*b*). The locking member 450 further includes a base surface 457 that contacts corresponding biasing members or coil springs 460 (identified individually as a first coil spring 460*a* and a second coil spring 460*b*). The coils springs 460 are compressed against the corresponding biasing member locating features 435 in the bottom cover 425 and urge the locking member 450 away therefrom. The pin 454, which extends through the locking member 450, slides in the corresponding guide channels 438 to limit the movement of the locking member 450 with reference to the frame 430. Further details regarding the locking member 450 are described below with reference to FIG. 7.

According to a further aspect of the embodiment illustrated in FIG. 4, the button 220 includes pivot legs 463 (identified individually as a first pivot leg 463*a* opposite a second pivot leg 463*b*) extending outwardly from the button 220. The pivot legs 463 are positioned between the top cover 423 and the base 436 of the frame 430 to allow the button 220 to pivot within the buckle assembly 110 when a user depresses or otherwise actuates the button 220. Further details regarding the button 220 are described below with reference to FIG. 8, and further details regarding the assembly and operation of the buckle assembly 110 are described below with reference to FIGS. 9A-9H.

Figure 5A:
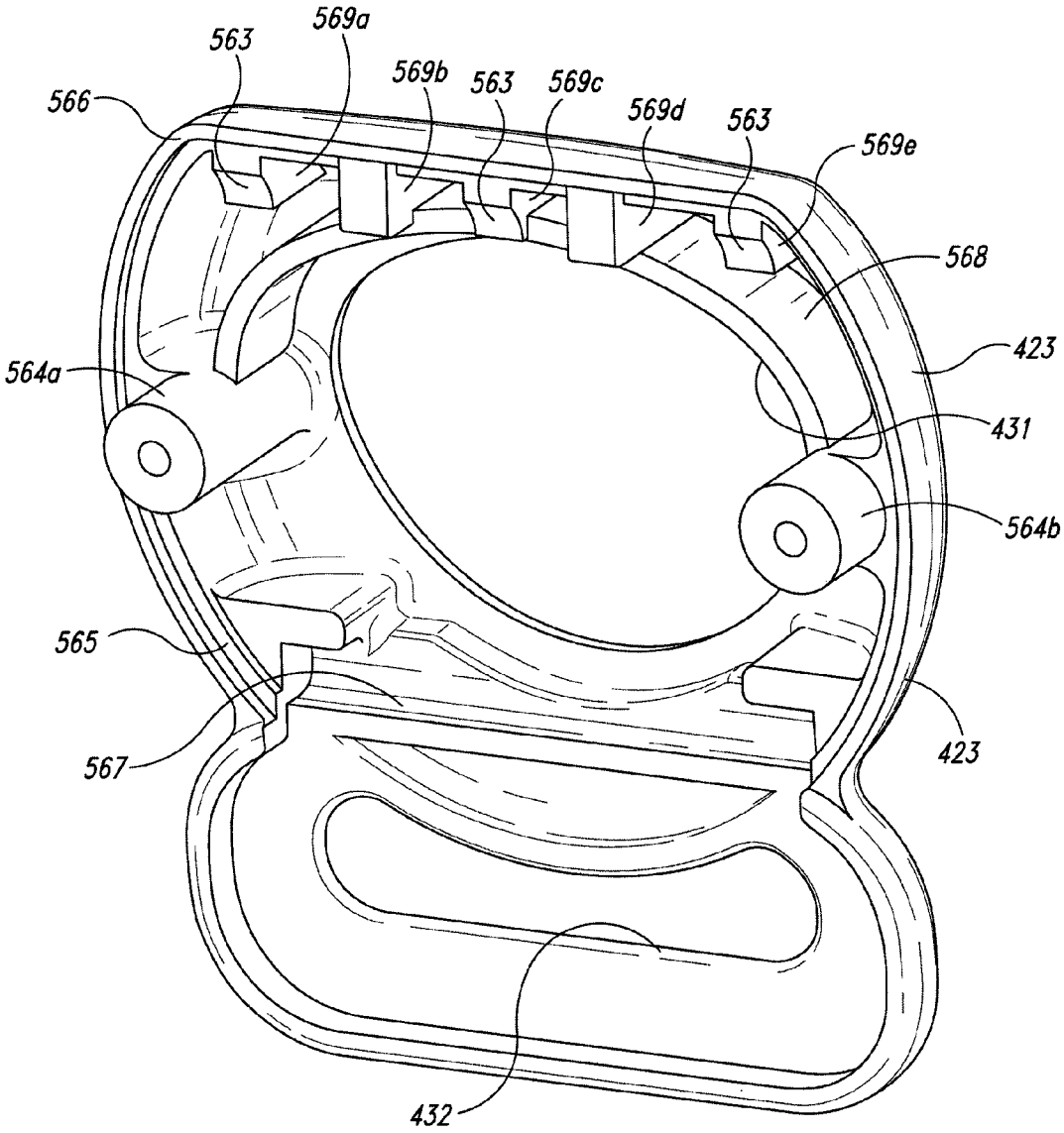
FIGS. 5A and 5B are isometric views of covers of the buckle assembly of FIG. 4.

FIG. 5A is an isometric view of the top cover 423 of the buckle assembly 110 of FIG. 4. In the illustrated embodiment, the top cover 423 includes locating features 564 (identified individually as a first locating feature 564*a* and a second locating feature 564*b*) on opposite sides of the button opening 431. The top cover 423 also includes a proximal end portion 565 opposite a distal end portion 566. The proximal end portion 565 includes the web opening 432, as well as a pivot leg recess 567 extending laterally across the top cover 423. The pivot leg recess 567 is configured to at least partially receive the pivot legs 463 of the button 220. The distal end portion 566 of the top cover 423 includes a rib portion 568 extending between the top cover locating features 564 adjacent to the button aperture 431. The distal end portion 566 also includes frame positioning features or ribs 569 (identified individually as first-fifth frame positioning ribs 569*a*-569*e*). In the illustrated embodiment, each of the first frame position rib 569*a*, the third frame positioning rib 569*c*, and the fifth frame positioning rib 569*e* includes a frame contacting portion 563 configured to contact and/or align the tongue receiving portion 442 of the frame 430 with the bottom cover 425 (FIG. 4).

Figure 5B:
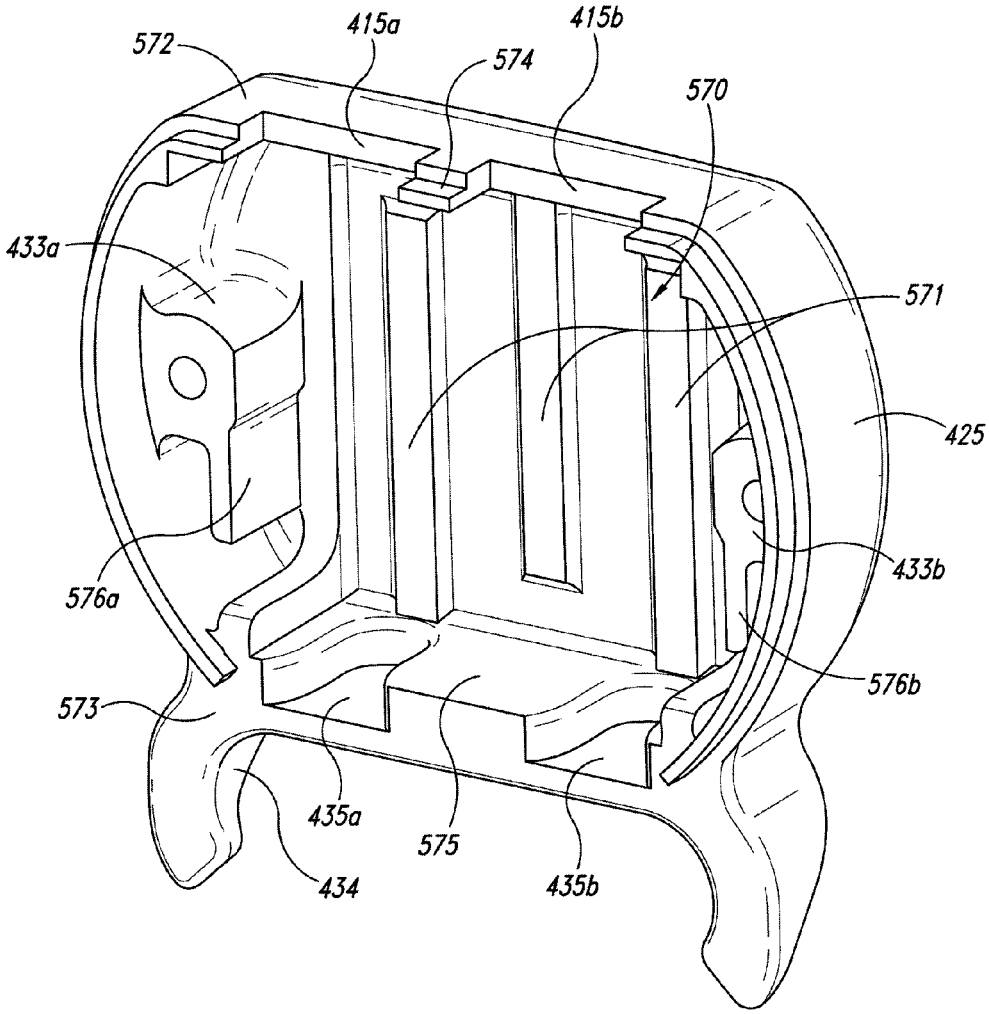

FIG. 5B is an isometric view of the bottom cover 425 of the buckle assembly 110 of FIG. 4. In the illustrated embodiment, the bottom cover 425 includes the bottom cover locating features 433 on opposite sides of a cavity 570. The bottom cover locating features 433 are configured to be aligned with and/or coupled to the corresponding top cover locating features 564 of the top cover 423 (FIG. 5A). The bottom cover 425 also includes frame sidewall guides 576 (identified individually as a first frame sidewall guide 576*a* and a second frame sidewall guide 576*b*) extending from the corresponding bottom cover locating features 433 toward the proximal end portion 573. The illustrated embodiment further includes several raised portions 571 extending along the bottom cover 425 in the cavity 570 from the proximal end portion 573 to a distal end portion 572 of the bottom cover 425. The distal end portion 572 includes a divider rib 574 separating the first tongue recess 415*a* from the second tongue recess 415*b*. The proximal end portion 573 includes the web recess 434, as well as the biasing member locating features 435 recessed from a rear wall 575 of the bottom cover 425.

In one embodiment, each of the top cover 423 and the bottom cover 425 can be formed from plastics (e.g., ejection-molded plastics), composites, and/or other suitable non-metallic materials known in the art. In other embodiments, however, top cover 423 and/or the bottom cover 425 can be formed from suitable metallic materials, such as cast metals.

Figure 6:
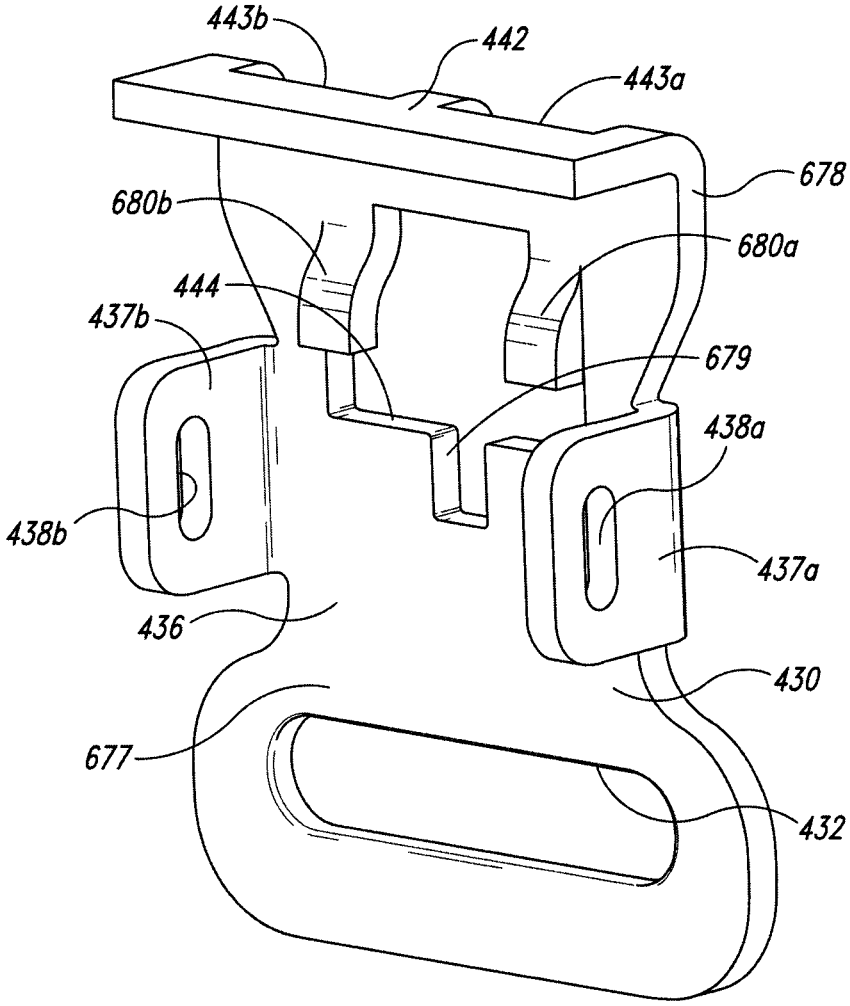
FIG. 6 is an isometric view of a frame of the buckle assembly of FIG. 4.

FIG. 6 is an isometric view of the frame 430 of the buckle assembly 110 of FIG. 4. In the illustrated embodiment, the sidewalls 437 are configured to be positioned adjacent and interior to the frame sidewall guides 576 in the bottom cover 425 (FIG. 5B). The frame 430 also includes a proximal end portion 677 with the attachment opening 400 opposite a distal end portion 578 with the tongue receiving portion 442 and corresponding tongue openings 443. The frame 430 further includes the button opening 444 extending through the base 436. The button opening 444 has an extension portion 679 extending toward the proximal end portion 677 of the frame 430. As such, the shape of the button opening 444 generally corresponds to the various projections or surfaces extending away from the button 220, which are described in detail below with reference to FIG. 8.

According to another feature of the illustrated embodiment, the frame 430 includes locking features 680 (identified individually as a first locking feature 680*a* and a second locking feature 680*b*) extending from the distal end portion 678 toward the proximal end portion 677 and are adjacent to the button opening 444. The locking features are offset from the base 436 and configured to extend toward the bottom cover 425 when the frame 430 is positioned between the bottom cover 425 and the top cover 423. Each locking feature 680 includes a locking surface or edge 681 (identified individually as a first locking edge 681*a* and a second locking edge 681*b*) that is configured to contact the engagement edge 219 of the corresponding tongue 214.

According to one aspect of the illustrated embodiment, the locking features 680 and the sidewalls 437 are integrally formed with the base 436. In other embodiments, however, the locking features 680 and/or the sidewalls 437 can be separate components that are attached (e.g., welded) to the base 436. Moreover, the frame 430 can be manufactured from a suitable metallic material, such as steel plate that is stamped and formed to shape. In other embodiments, other metals (e.g., other steels, aluminum, etc.) that are stamped, pressed, cast, forged, machined, and/or otherwise formed to shape using suitable methods known in the art can be used. In further embodiments, the frame 430 can be manufactured from composites and/or other suitable nonmetallic materials having suitable strength, stiffness, and/or other characteristics.

Figure 7:
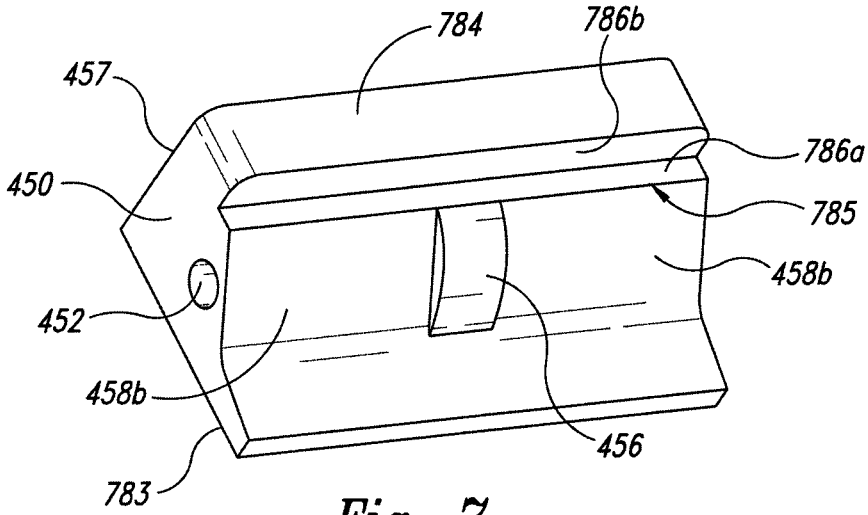
FIG. 7 is an isometric view of a locking member of the buckle assembly of FIG. 4.

FIG. 7 is an isometric view of the locking member 450 of the buckle assembly 110 of FIG. 4. In the illustrated embodiment, the locking member 450 includes the sliding pin aperture 452 extending laterally therethrough, as well as the button contact surface 456 positioned between the tongue contact surfaces 458. The button contact surface 456 and the tongue contact surfaces 458 are positioned at an inclined angle with reference to a base surface 783 of the locking member 450. Moreover, in the illustrated embodiment the button contact surface 456 is generally curved or convex, and each of the tongue contact surfaces 458 is generally flat or planar. In other embodiments, however, these surfaces can include other suitable shapes. For example, all of these surfaces can be planar, or all of the surfaces can be curved.

According to another aspect of the illustrated embodiment, the base surface 457 of the locking member 450 extends from the base surface 783 toward an upper surface 784. The locking member 450 also includes a tongue locking feature or shelf 785 between the upper surface 784 and each of the button contact surface 456 and the tongue contact surfaces 458. The shelf 785 includes a first tongue engagement surface 786*a* extending generally perpendicular to a second tongue engagement surface 786*b*. As explained in detail below, the tongue engagement surfaces 786 engage or otherwise support the tongues 214 when the web connectors 112 are fully inserted into the buckle assembly (FIG. 2B).

In one embodiment, the locking member 450 can be formed from plastics (e.g., ejection-molded plastics), composites, and/or other suitable non-metallic materials known in the art. In other embodiments, however, the locking member 450 can be formed from suitable metallic materials, including, for example, cast metals.

Figure 8:
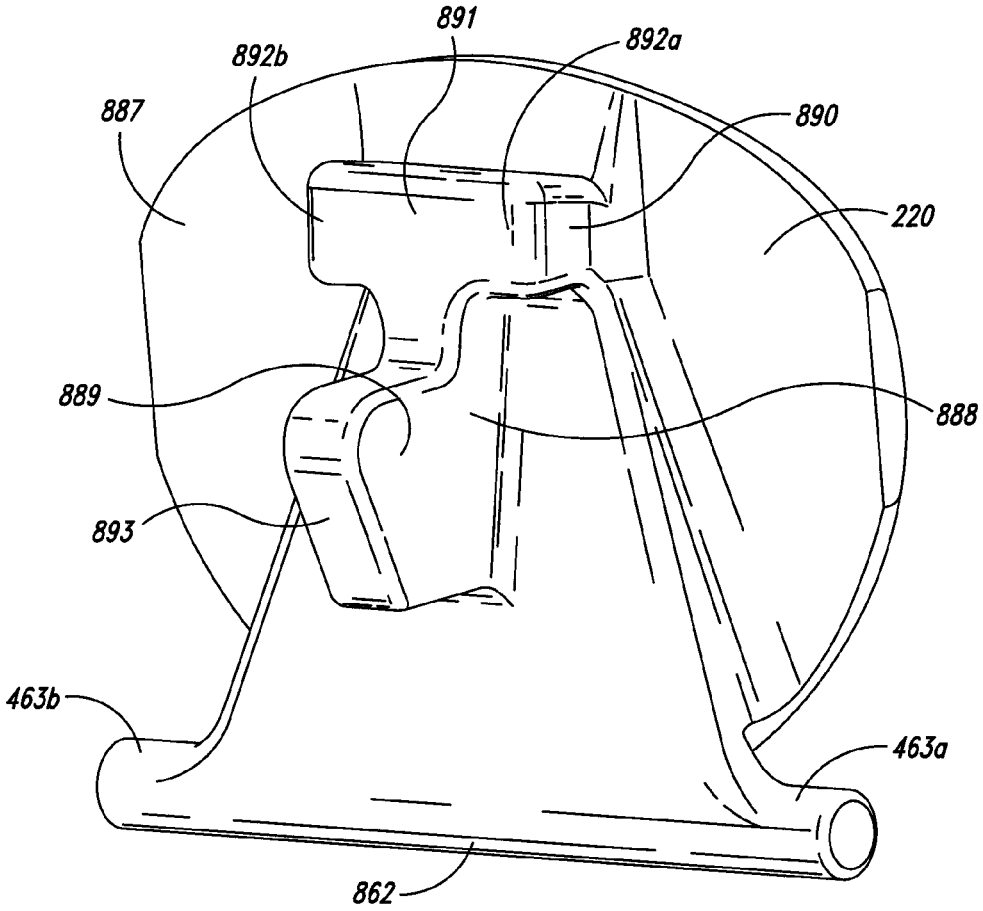
FIG. 8 is an isometric view of a button of the buckle assembly of FIG. 4.

FIG. 8 is an isometric view of the button 220 of the buckle assembly 110 of FIG. 4. In the illustrated embodiment, the pivot legs 463 extend outwardly from a pivot portion 862. The button also includes an ejecting feature 888 projecting from an underside 887 of the button 220. The ejecting feature 888 is spaced apart from the pivot portion 862 and includes a proximal end portion 889 opposite a distal end portion 890. The distal end portion 890 includes a tongue urging surface 891 having a first lateral side portion 892*a* opposite a second lateral side portion 892*b*. In the illustrated embodiment, the tongue urging surface 891 is generally planar and generally parallel to the underside 887 of the button 220. The proximal end portion 889 of the ejecting feature 888 includes a locking member urging surface 893. In the illustrated embodiment, the locking member urging surface 893 is generally planar and positioned at an inclined angle with reference to the underside 887 of the button 220. As explained in detail below with reference to FIG. 9A-9H, the ejecting feature 888 is configured to pivot within the housing 222 to move or displace the locking member 450 and the tongues 214 and disengage the corresponding web connectors 112 from the buckle assembly 110. For example, the tongue urging surface 891 is configured to contact and/or slide against the tongues 214, and the locking member urging surface 893 is configured to contact and/or slide along the locking member 450 when a user depresses or otherwise actuates the button 220 to release the web connectors 112 from the buckle assembly 110.

Figure 9A:
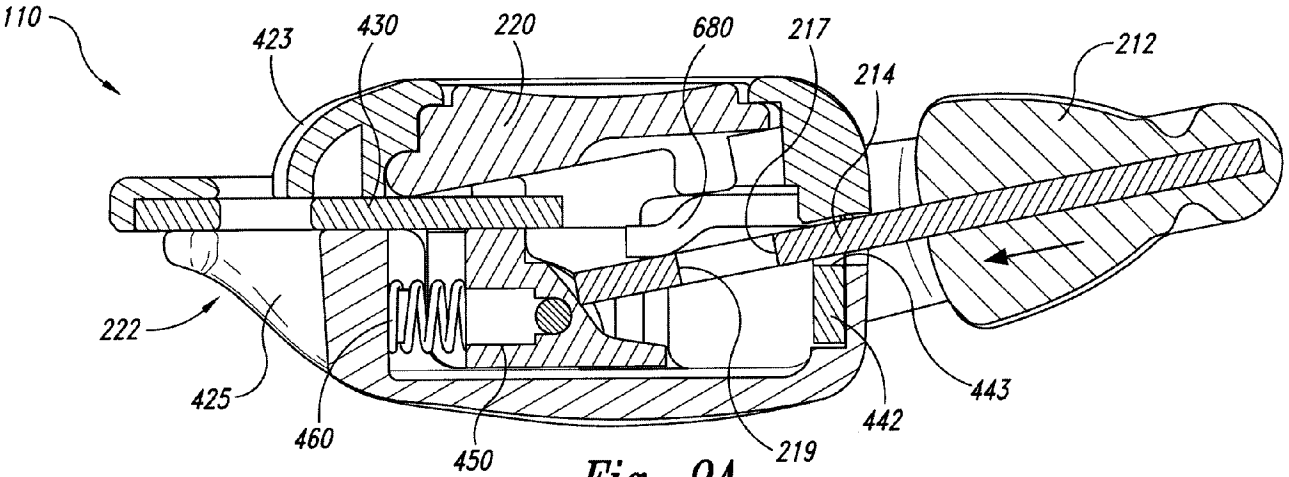
FIGS. 9A-9H are a series of cross-sectional views taken substantially along the lines 9-9 of FIG. 2B illustrating various operational aspects of the buckle assembly and corresponding components illustrated in FIGS. 1-8.

FIGS. 9A-9H are a series of cross-sectional views taken substantially along the lines 9-9 of FIG. 2B illustrating various stages of operation of the buckle assembly 110 and the corresponding components described above with reference to FIGS. 1-8. Referring first to FIG. 9A, the frame 430 is secured in the housing 222 between the top cover 423 and the bottom cover 425. The top cover 423 pivotally retains the button 220 against the frame 430, and the bottom cover 425 slidably retains the locking member 450 against the frame 430. As shown in FIG. 9A, the coil springs 460 urge the locking member 450 toward the tongue 214 in a first or locked position. When an operator inserts the tongue 214 through the tongue opening 443 of the frame 430 to releasably engage the locking feature 680 of the frame 430, the tongue 214 contacts the tongue contact surface 456 of the locking member 450. During the initial insertion of the tongue 214 into the buckle assembly 110, the tongue 214 is positioned at an inclined angle relative to the frame 430. At this point, the engagement edge 219 of the pawl opening 217 is positioned below the locking feature 680 of the frame 430, and therefore not engaged with the locking feature 680.

Figure 9B:
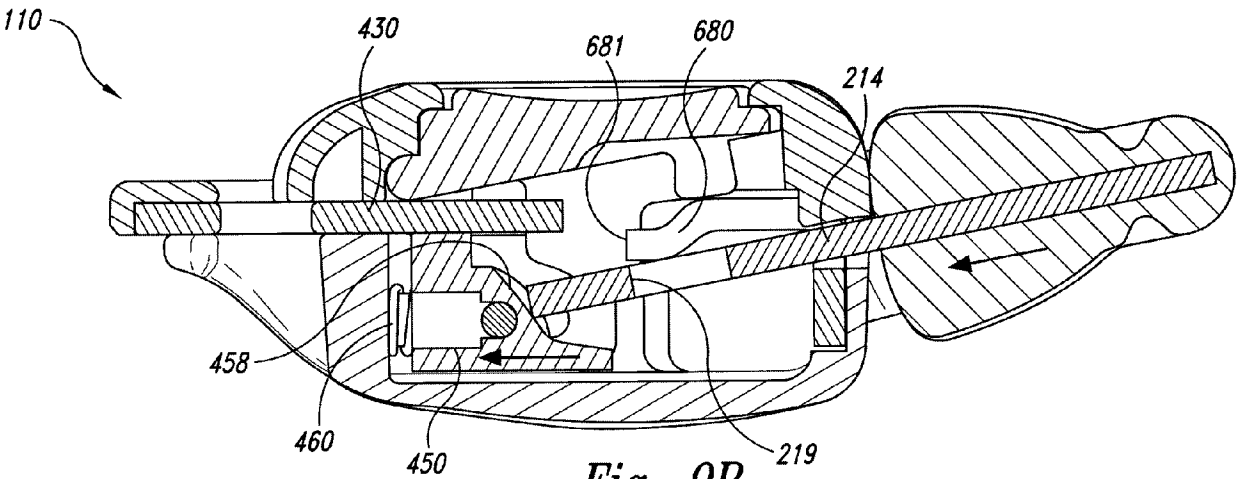
Figure 9C:
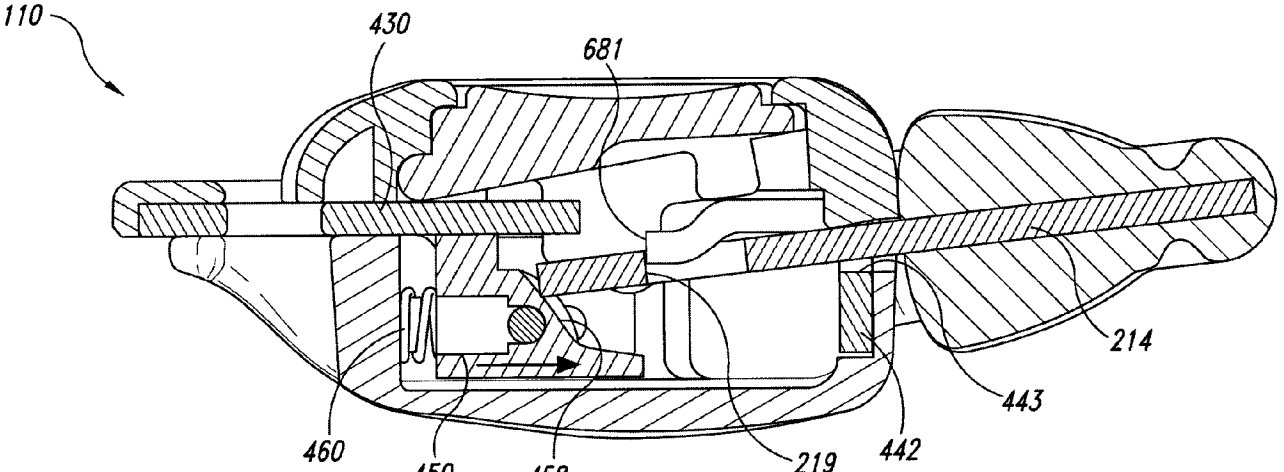

Referring next to FIG. 9B, as the operator continues to insert the tongue 214 into the buckle assembly 110, the tongue 214 moves the locking member 450 out of the locked position. More specifically, the tongue 214 urges the tongue contact surface 458 of the locking member 450 to compress the coil spring 460 and move the locking member 450 out of the locked position. As the locking member 450 moves out of the locked position, the engagement locking edge 219 of the tongue 214 clears the corresponding locking edge 681 of the locking feature 680 of the frame 450. As shown in FIG. 9C, once the engagement edge 219 clears or passes the locking edge 681, the coil springs 460 drive the locking member 450 back toward the locked position. More specifically, after the engagement edge 219 clears the locking edge 681, the tongue 214 slides up the tongue contact surface 458 of the locking member 450 as the coil spring 460 biases the locking member 450 toward the locked position. In addition, as the tongue 214 slides up the tongue contact surface 458, the tongue 214 pivots about the tongue opening 443 in the tongue receiving portion 442 of the frame 430.

Figure 9D:
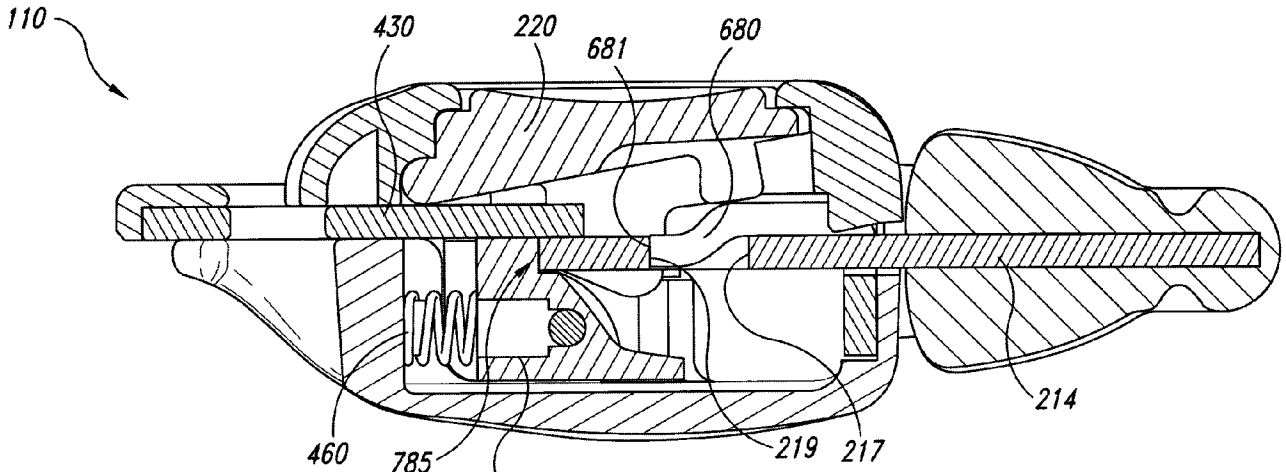

Referring next to FIG. 9D, the locking member 450 has returned to the locked position and securely retains the tongue 214 in a locked position against the locking feature 680 of the frame 430. More specifically, when the tongue 214 is fully inserted in the buckle assembly 110 with the locking member 450 in the locked position, the shelf 785 of the locking member 450 receives the tongue 214 to retain the engagement edge 219 against the locking edge 681. In this position, the locking feature 680 is positioned in the pawl aperture 217 of the tongue 214, and the tongue 214 is generally parallel with the frame 430. With the tongue 214 resting in the shelf 785 and the coil spring 460 biasing the locking member 450 in the locked position, the tongue 214 cannot disengage the locking feature 680 of the frame 430 until the button 220 moves the locking member 450 out of the locked position, as described in detail below with reference to FIGS. 9E-9H.

Figure 9E:
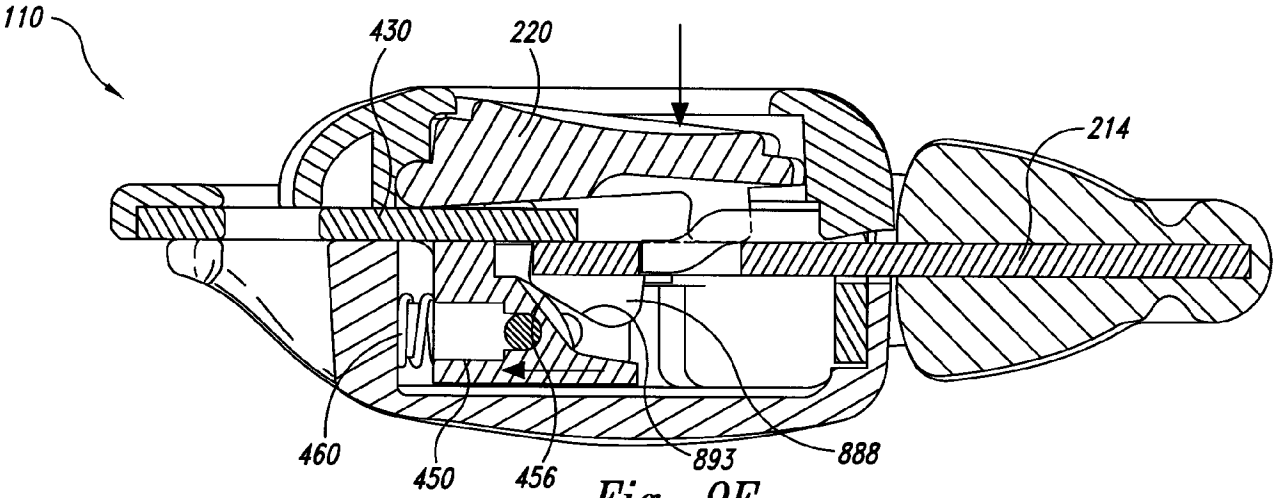

Referring next to FIG. 9E, when a user depresses the button 220 to release the connector 112 (e.g., by applying a force to the button 220 in a direction substantially toward to the frame 430), the ejection feature 888 of the button 220 drives the locking member 450 away from the tongue 214 and out of the locked position. More specifically, as the button 220 pivots downwardly, the locking member urging surface 893 slides against the button contact surface 456 of the locking member 450 and moves the locking member 450 out of the locked position.

Figure 9F:
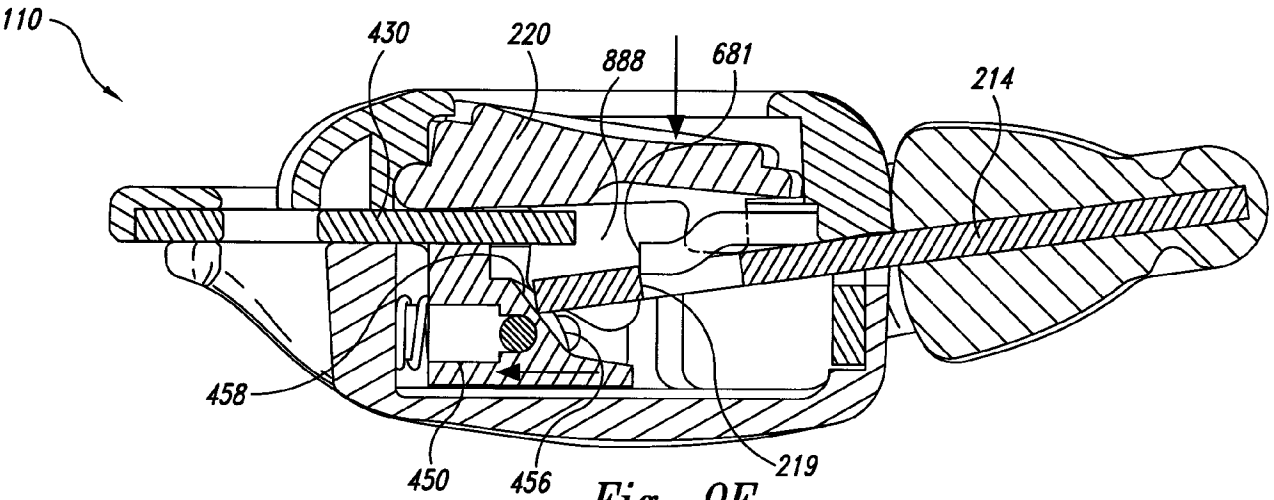
Figure 9G:
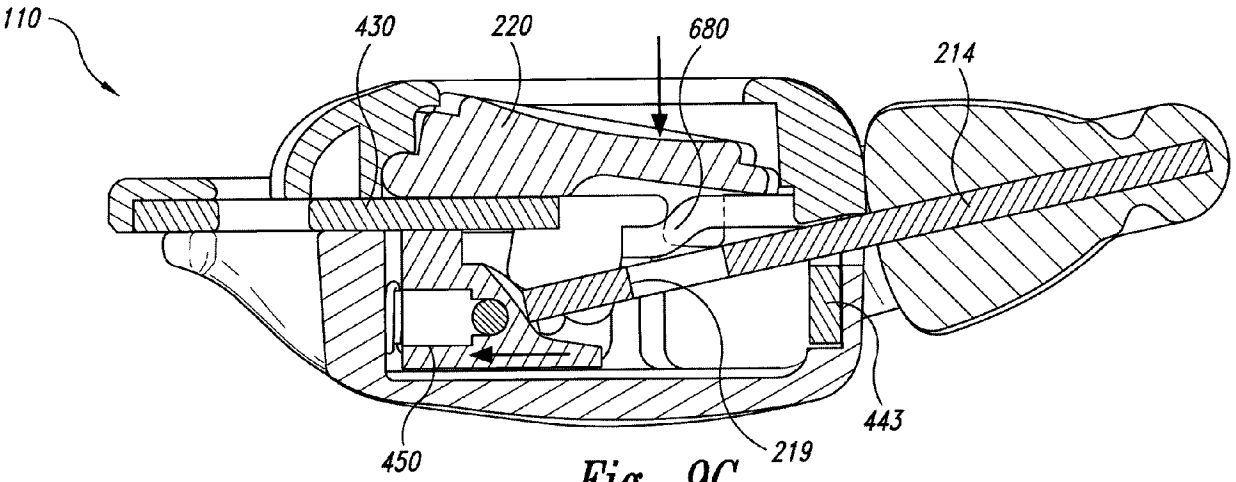

Referring next to FIG. 9F, as the button 220 is further actuated or depressed, the ejection feature 888 presses against the tongue 214 to disengage the engagement edge 219 from the locking edge 681. As shown in FIG. 9G, once the button 220 moves the locking member 450 to the unlocked position, the engagement edge 219 clears the locking feature 680 of the frame 430 and the tongue 214 pivots about the tongue receiving opening 443 of the frame 430.

Figure 9H:
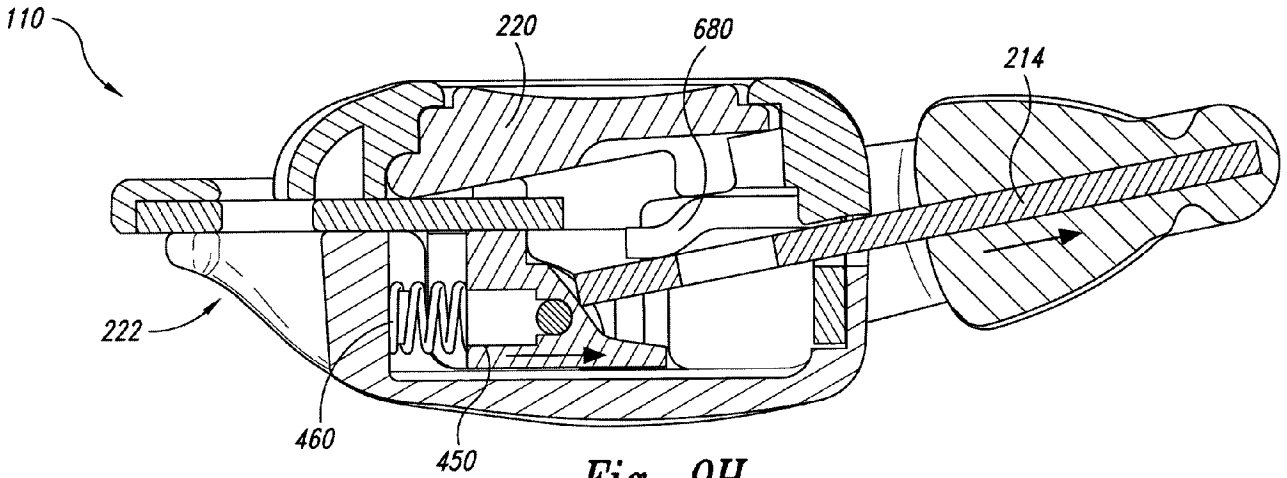

Referring next to FIG. 9H, once the button 220 is released, the coil springs 460 drive the locking member 450 back toward the locked position. Since the tongue 214 has disengaged the locking feature 680, the locking member 450 also automatically ejects or drives the tongue 214 out of the housing 222 as the locking member 450 moves back toward the locking position.

The embodiments of the buckle assembly 110 described above provide several advantages over conventional buckle assemblies. One advantage, for example, is that the locking member 450 securely retains the tongues 214 engaged with the locking features 680 when the locking member 450 is in the locked position. Another advantage is that the tongues 214 are positioned at an inclined angle with reference to the frame 430 when the tongues 214 are being inserted into or ejected from the buckle assembly 110. Moreover, when the tongues 214 are retained in the locked position, the tongues 214 are generally parallel to the frame. Accordingly, by the position of the tongues 214 relative to the frame 430 (e.g., at an inclined angle or generally parallel), a user can easily verify if the tongues 214 are securely retained in the buckle assembly 110.

From the foregoing, it will be appreciated that specific embodiments of the disclosure have been described herein for purposes of illustration, but that various modifications may be made without deviating from the spirit and scope of the various embodiments of the disclosure. Further, while various advantages associated with certain embodiments of the disclosure have been described above in the context of those embodiments, other embodiments may also exhibit such advantages, and not all embodiments need necessarily exhibit such advantages to fall within the scope of the invention. Accordingly, the disclosure is not limited, except as by the appended claims.

We claim:

1. A personal restraint system for use in a vehicle, the personal restraint system comprising:

a connector configured to be coupled to a web, wherein the connector includes a tongue having an engagement portion; and a buckle assembly configured to releasable retain the tongue of the connector, the buckle assembly including:

a frame having a locking feature that contacts the engagement portion when the tongue is inserted into the buckle assembly;

a locking member adjacent to the frame, wherein the locking member is movable relative to the frame between a locked position and an unlocked position, and wherein the locking member retains the engagement portion of the tongue in contact with the locking feature when the locking member is in the locked position;

a button adjacent to the frame, wherein the button is movable relative to the frame to urge the locking member away from the locked position and to urge the tongue away from the locking feature; and a housing at least partially enclosing the frame and the locking member, wherein the frame remains stationary relative to the housing and the tongue pivots relative to the housing to disengage the locking feature from the engagement portion.

2. A personal restraint system for use in a vehicle, the personal restraint system comprising:

a connector configured to be coupled to a web, wherein the connector includes a tongue having an engagement portion; and a buckle assembly configured to releasable retain the tongue of the connector, the buckle assembly including:

a frame having a locking feature that contacts the engagement portion when the tongue is inserted into the buckle assembly;

a locking member adjacent to the frame, wherein the locking member is movable relative to the frame between a locked position and an unlocked position, and wherein the locking member retains the engagement portion of the tongue in contact with the locking feature when the locking member is in the locked position; and a button adjacent to the frame, wherein the button is movable relative to the frame to urge the locking member away from the locked position and to urge the tongue away from the locking feature, and wherein the tongue urges the locking member from the locked position toward the unlocked position when the tongue is inserted into the buckle assembly.

3. The personal restraint system of claim 2 wherein the button simultaneously contacts the locking member and the tongue to urge the locking member away from the locked position and to urge the tongue away from the locking feature.

4. The personal restraint system of claim 2:

wherein the tongue is at least generally parallel to the frame when the engagement portion engages the locking feature; and wherein the tongue is positioned at an inclined angle relative to the frame when the engagement portion disengages the locking feature.

5. The personal restraint system of claim 2 wherein the locking member comprises:

a tongue contact surface configured to slide against a distal edge of the tongue; and a button contact surface separate from the tongue contact surface and configured to contact the button.

6. The personal restraint system of claim 2 wherein the button comprises an ejecting feature extending from an underside of the button, the ejecting feature having:

a locking member urging surface configured to slide against the locking member, wherein the locking member urging surface is at an inclined angle relative to the underside of the button;

and a tongue urging surface separate from the locking member urging surface and configured to slide against the tongue.

7. The personal restraint system of claim 2, further comprising:

a first cover;

a second cover opposite the first cover, wherein the first and second covers form an insertion opening;

wherein the button pivots between the first cover and the frame;

wherein the locking member slides between the second cover and the frame; and wherein the tongue is inserted and retracted through the insertion opening and pivots about the insertion opening.

8. The personal restraint system of claim 2:

wherein the frame further comprises at least one sidewall extending from a base portion, the sidewall having a guide channel; and wherein the locking member further comprises a guide member extending laterally therefrom, wherein the guide channel at least partially receives the guide member to limit the movement of the locking member between the locked and unlocked positions.

9. The personal restraint system of claim 2 wherein the engagement portion includes an engagement surface extending into an aperture.

10. A personal restraint system for use in a vehicle, the personal restraint system comprising:

a connector configured to be coupled to a web, wherein the connector includes a tongue having an engagement portion; and a buckle assembly configured to releasably retain the tongue of the connector, the buckle assembly including:

a frame having a locking feature that contacts the engagement portion when the tongue is inserted into the buckle assembly;

a locking member adjacent to the frame, wherein the locking member is movable relative to the frame between a locked position and an unlocked position, and wherein the locking member retains the engagement portion of the tongue in contact with the locking feature when the locking member is in the locked position;

a button adjacent to the frame, wherein the button is movable relative to the frame to urge the locking member away from the locked position and to urge the tongue away from the locking feature; and at least one biasing member urging the locking member toward the locked position, wherein the locking member at least partially ejects the tongue from the buckle assembly when the tongue disengages from the locking feature and the locking member moves from the unlocked position toward the locked position.

11. A connector and buckle assembly for use in a vehicle, the assembly comprising:

a web;

a connector configured to be coupled to the web, wherein the connector has a tongue; and a buckle assembly configured to releasable retain the connector when the tongue is inserted into the buckle assembly, the buckle assembly including:

a frame having a locking feature configured to engage the tongue in a locked position;

a locking member movably positioned adjacent to the frame and biased toward the tongue, wherein the locking member retains the tongue in the locked position; and an actuator movably positioned adjacent to the frame, wherein manipulation of the actuator drives the actuator against each of the locking member and the tongue to move the tongue out of the locked position, wherein the locking member is slidably positioned adjacent to a first side of the frame, and the actuator is pivotally positioned adjacent to a second side of the frame, and wherein the second side is opposite the first side.

12. A connector and buckle assembly for use in a vehicle, the assembly comprising:

a web;

a connector configured to be coupled to the web, wherein the connector has a tongue; and a buckle assembly configured to releasably retain the connector when the tongue is inserted into the buckle assembly, the buckle assembly including:

a frame having a locking feature configured to engage the tongue in a locked position;

a locking member movably positioned adjacent to the frame and biased toward the tongue, wherein the locking member retains the tongue in the locked position;

an actuator movably positioned adjacent to the frame, wherein manipulation of the actuator drives the actuator against each of the locking member and the tongue to move the tongue out of the locked position, and at least one biasing member that urges the locking member toward the locked position.

13. The personal restraint system of claim 12 wherein the locking member includes a first contact surface separate from a second contact surface, and wherein the tongue slides along at least a portion of the first contact surface and the actuator slides along at least a portion of the second contact surface.

14. The personal restraint system of claim 12 wherein the connector is a first connector, the tongue is a first tongue, the web is a first web, and the locking feature is a first locking feature, and wherein the personal restraint system further comprises:

a second web; a second connector configured to be coupled to the second web, wherein the second connector has a second tongue; and a second locking feature on the frame, wherein the second locking feature retains the second tongue in the locked position, and wherein manipulation of the actuator drives the actuator against each of the locking member, the first tongue, and the second tongue to move the first and second tongues out of the locked position.

15. The personal restraint system of claim 12 wherein the locking feature is integrally formed with the frame, and wherein the frame remains stationary with reference to the actuator, the locking member, and the connector.

16. A personal restraint system for use in a vehicle, the personal restraint system comprising:

a connector configured to be coupled to a web, wherein the connector includes a tongue having a locking feature; and a buckle assembly configured to releasably engage the connector when the tongue is inserted into the buckle assembly, the buckle assembly including:

means for engaging the locking feature of the tongue to secure the tongue to the buckle assembly when the tongue is inserted into the buckle assembly in a locked position;

means for retaining the locking feature against the means for engaging when the tongue is in the locked position;

means for moving the means for retaining the locking feature away from the tongue to release the tongue from the locked position;

means for moving the tongue away from the means for engaging to release the tongue from the locked position; and means for urging the tongue out of the buckle assembly when the tongue is not in the locked position.

17. The personal restraint system of claim 16:

wherein the means for retaining comprises a locking member that moves along a linear path in the buckle assembly; and wherein the means for moving the means for retaining and the means for moving the tongue comprises an actuator that pivots in the buckle assembly.

* * * * *